US011825915B2

(12) United States Patent
Jurkovic et al.

(10) Patent No.: US 11,825,915 B2
(45) **Date of Patent: *Nov. 28, 2023**

(54) SHOE BUFFING SYSTEM

(71) Applicant: NIKE, Inc., Beaverton, OR (US)

(72) Inventors: Dragan Jurkovic, Taichung (TW); Shih-Yuan Wu, Taichung (TW); Chia-Wei Chang, Kaohsiung (TW); Wen-Ruei Chang, Changhua (TW); Chien-Chun Chen, YunLin (TW); Chang-Chu Liao, YunLin (TW); Chia-Hung Lin, Changhua (TW)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/856,125

(22) Filed: Jul. 1, 2022

(65) Prior Publication Data

US 2022/0330663 A1 Oct. 20, 2022

Related U.S. Application Data

(60) Continuation of application No. 16/847,400, filed on Apr. 13, 2020, now Pat. No. 11,406,160, which is a division of application No. 15/978,997, filed on May 14, 2018, now Pat. No. 10,617,177.

(60) Provisional application No. 62/506,395, filed on May 15, 2017.

(51) Int. Cl.
*A43D 95/08* (2006.01)
*A43D 8/32* (2006.01)
(Continued)

(52) U.S. Cl.
CPC ..... *A43D 95/08* (2013.01); *A43D 8/32* (2013.01); *A43D 8/34* (2013.01); *A43D 8/36* (2013.01);
(Continued)

(58) Field of Classification Search
CPC ..... A43D 95/08; A43D 95/24; A43D 95/16; A43D 95/22; A43D 37/00; A43D 8/24; A43D 8/32; A43D 8/36
(Continued)

(56) References Cited

U.S. PATENT DOCUMENTS 1,993,753 A 3/1935 Milton
3,113,446 A 12/1963 Herman
(Continued)

FOREIGN PATENT DOCUMENTS

CN 103302563 A 9/2013
CN 103535994 A 1/2014
(Continued)

*Primary Examiner* — Marie D Bays
(74) *Attorney, Agent, or Firm* — SHOOK, HARDY & BACON L.L.P.

(57) ABSTRACT

An apparatus for buffing a shoe part includes a housing adapted to be articulated around at least a portion of the footwear part. A rotating spindle is positioned in the housing and has a buffing surface for engagement with the footwear part. A carriage is slideably connected to the housing and holds the spindle such that the buffing surface can be moved closer to and further away from the footwear part. An actuator is in the housing and in contact with the carriage. The actuator applies force to the carriage to increase the force of the buffing surface onto the footwear part. A biasing member is in the housing and in contact with the carriage. The biasing member exerts force onto the carriage in a direction opposite the force exerted by the actuator.

13 Claims, 9 Drawing Sheets

(51) Int. Cl.

| | |
|---|---|
| ***A43D 8/44*** | (2006.01) |
| ***A43D 95/24*** | (2006.01) |
| ***A43D 8/34*** | (2006.01) |
| ***A43D 8/36*** | (2006.01) |
| ***A43D 95/02*** | (2006.01) |
| ***A43D 37/00*** | (2006.01) |

(52) U.S. Cl.
CPC ..... *A43D 8/44* (2013.01); *A43D 37/00* (2013.01); *A43D 95/02* (2013.01); *A43D 95/24* (2013.01)

(58) Field of Classification Search
USPC ..... 12/70, 77, 78, 79.2, 77.5
See application file for complete search history.

(56) References Cited

U.S. PATENT DOCUMENTS

| | | | | |
|---|---|---|---|---|
| 3,163,031 | A | 12/1964 | Aubrey | |
| 3,233,438 | A | 2/1966 | Tore et al. | |
| 3,400,561 | A | 9/1968 | Johann | |
| 3,603,120 | A | 9/1971 | Schilke | |
| 3,681,803 | A | 8/1972 | Pisaroni | |
| 3,961,390 | A | 6/1976 | Giordano | |
| 4,010,502 | A | 3/1977 | Cushing et al. | |
| 4,126,020 | A | 11/1978 | Tutt et al. | |
| 4,181,994 | A * | 1/1980 | Gruber | A43D 37/00 12/17.2 |
| 4,756,038 | A | 7/1988 | Stein | |
| 4,951,338 | A | 8/1990 | Brown et al. | |
| 11,406,160 | B2 * | 8/2022 | Jurkovic | A43D 8/32 |
| 2018/0325219 | A1 | 11/2018 | Jurkovic et al. | |
| 2019/0365054 | A1 | 12/2019 | Chang et al. | |
| 2020/0237054 | A1 | 7/2020 | Jurkovic et al. | |

FOREIGN PATENT DOCUMENTS

| | | | |
|---|---|---|---|
| CN | 203523953 | U | 4/2014 |
| CN | 205321425 | U | 6/2016 |
| EP | 0265758 | A2 | 5/1988 |
| KR | 100656743 | B1 | 12/2006 |
| TW | 163558 | | 7/1991 |
| TW | M325760 | U | 1/2008 |
| TW | 201515767 | A | 5/2015 |

* cited by examiner

SHOE BUFFING SYSTEM

CROSS-REFERENCE TO RELATED APPLICATIONS

This application is a Continuation Application of U.S. application Ser. No. 16/847,400, entitled "Shoe Buffing System," and filed Apr. 13, 2020, which is a Divisional Application of U.S. application Ser. No. 15/978,997, entitled "Shoe Buffing System," and filed May 14, 2018, now U.S. Pat. No. 10,617,177, which claims the benefit of U.S. Provisional Application No. 62/506,395, entitled "Shoe Buffing System," and filed May 15, 2017. The entirety of the aforementioned application is incorporated by reference herein.

TECHNICAL FIELD

Aspects hereof relate to apparatuses, systems and methods for buffing in connection with articles of footwear, e.g., shoes. More particularly, aspects relate to apparatuses, systems and methods for automatically buffing a portion of the shoe upper prior to the application of an adhesive to enhance the connection between the upper and the bottom unit.

BACKGROUND

Articles of footwear and, in particular, shoes may be made by combining components, such as uppers and bottom units, which may themselves be comprised of subcomponents. For instance, a shoe bottom unit may be comprised of a midsole and an outsole. Various techniques, such as the use of adhesives and/or cements, may be used to join one component, such as a shoe upper, to another component, such as a shoe bottom unit. In order to enhance the connection between the upper and the bottom unit, it has been found to be advantageous to buff or smooth the areas of the upper that are in contact with the bottom unit and to which adhesive is applied. This typically was done by hand, utilizing a powered rotary tool with a buffing head.

BRIEF SUMMARY

Aspects hereof provide an apparatus for buffing a footwear part. The apparatus includes a housing adapted to be articulated around at least a portion of the footwear part. A rotating spindle is positioned in the housing and has a buffing surface for engagement with the footwear part. A carriage is slideably connected to the housing and receives the spindle so that the buffing surface can be moved closer to and further away from the footwear part. The apparatus further includes an actuator positioned in the housing and in contact with the carriage. The actuator applies force to the carriage to increase the force of the buffing surface onto the footwear part. A biasing member is positioned in the housing and in contact with the carriage. The biasing member exerts a force onto the carriage in a direction opposite the force exerted by the actuator.

DESCRIPTION OF THE DRAWINGS

The present invention is described in detail herein with reference to the attached drawing figures, wherein.

DETAILED DESCRIPTION

Figure 1:
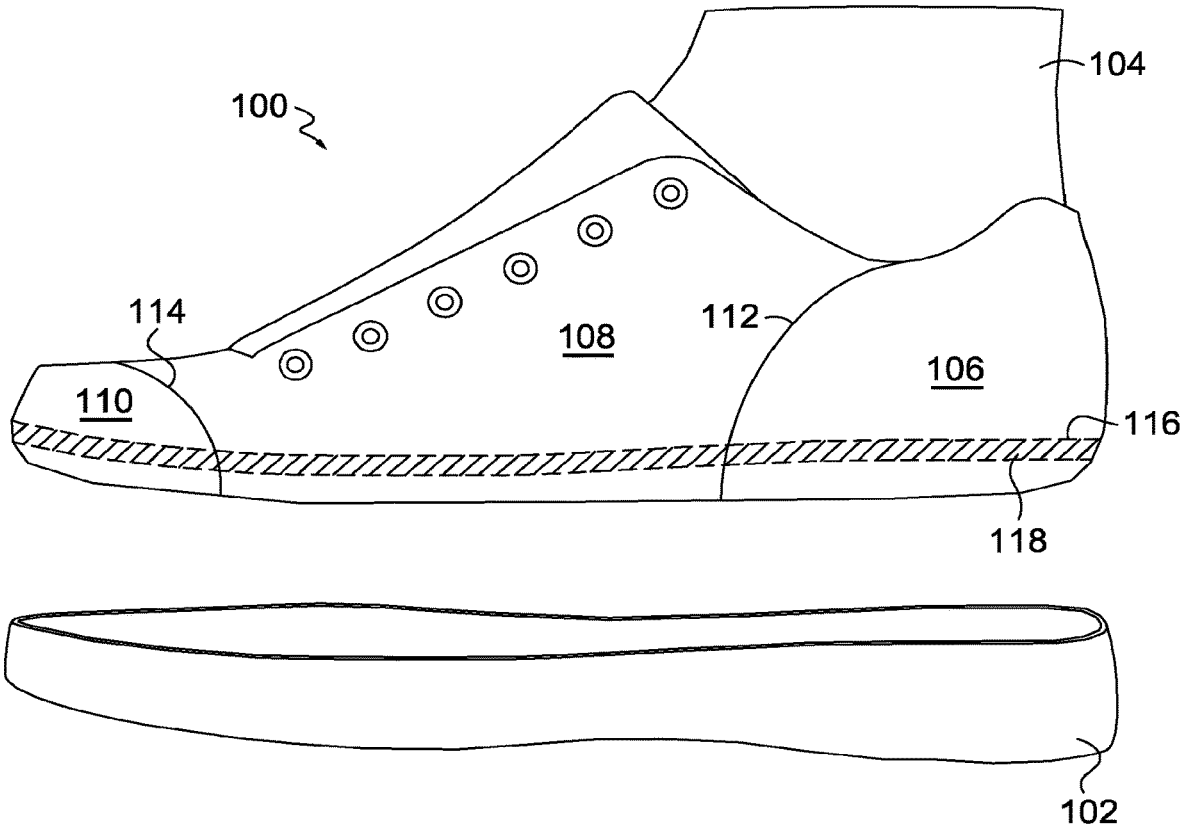
FIG. 1 depicts a shoe upper and a bottom unit prior to being connected together.

As a result of the desires for protection and support from an upper, cushioning from a midsole, and traction and durability from an outsole, a given shoe may utilize diverse materials and structural designs for these different components. Further, additional components that provide, for example, particularized impact protection, motion control for pronation or supination, varying degrees of support, additional impact protection, and the like may further complicate the design of all or part of a shoe. Nevertheless, these components must be ultimately integrated to form a wearable shoe that is both functional and, ideally, attractive.

One approach to shoe component integration is to use one or more adhesives to affix an outsole and a midsole together and then to use different or similar adhesives to affix the sole assembly (often simply referred to as a "bottom unit" or "sole") to the upper. When using such an approach, however, care must be taken to provide sufficient adhesive coverage and bonding force between the bottom unit and the upper in order to create an acceptably strong bond.

The present invention provides an apparatus, system and method of automatically buffing a shoe upper at a location where adhesive is normally applied to connect the upper to a bottom unit. More specifically, in that past, the buffing was traditionally done manually with a rotary tool. This manual operation was very time consuming and labor intensive. Further, it resulted in inconsistent results because of the varied pressure applied by the operator. By not having a consistent buffed area, oftentimes the adhesive will not properly engage the shoe upper resulting in separation of the shoe upper from the bottom unit. Still further, to the extent the buffing process can be automated, with for instance a robotic arm, there remain problems with the application of an appropriate amount of force to the shoe upper. More specifically, a rotating buffing tool mounted on a robotic arm will necessary need to be tilted at different angles to engage the appropriate surfaces to be buffed. As a result, gravity forces are exerted on the rotating tool. These gravity forces can result in too much or too little force being exerted on the shoe upper. Still further, there exists a need to allow the rotating tool to transition over seam areas. If there is no leeway or buffer associated with the rotary tool in these areas, either too much or too little material of the upper will be removed, again resulting in an inconsistent adhesion between the shoe upper and the bottom unit.

In a first aspect, an apparatus for buffing a footwear part includes a housing adapted to be articulated around at least a portion of the footwear part. A rotating spindle is positioned in the housing and has a buffing surface for engagement with the footwear part. A carriage is slideably connected to the housing and receives the spindle such that the buffing surface can be moved closer to and further away from the footwear part. An actuator is positioned in the housing and is in contact with the carriage. The actuator is capable of applying force to the carriage to increase the force of the buffing surface onto the footwear part. A biasing member is positioned in the housing and in contact with the carriage. The biasing member exerts force onto the carriage in a direction opposite the force exerted by the actuator.

In another aspect, a system for buffing a portion of an upper of an article of footwear includes a rotatable spindle having a buffing surface capable of engaging the upper. A robotic arm with the rotatable spindle mounted thereto is capable of articulating the buffing surface adjacent to selected portions of the upper. The spindle linearly moves with respect to the robotic arm. An actuator is coupled to the robotic arm and the spindle and is capable of applying a force from the buffing surface toward the upper. A biasing mechanism is coupled to the robotic arm and the spindle. The biasing mechanism applies a force directed away from the upper when the actuator applies a force towards the upper.

A method of buffing a shoe upper includes engaging at least a portion of the shoe upper with a rotating buffing spindle. A first force is applied to the buffing spindle by an actuator in a direction generally towards the shoe upper. A second force is applied to the buffing spindle by a biasing member in a direction generally opposite the first force.

Aspects hereof generally relate to shoes, especially athletic shoes, which may typically comprise an upper portion that at least partially encloses the foot of the wearer and a sole portion that protects the foot and contacts the ground, floor, or other surface upon which the wearer will stand, walk, run, etc. Uppers are often made of leather, fabric, textile sheets, other flexible sheet-like materials, or other types of material that may be curved and shaped in three dimensions and that are sufficiently pliable to receive human feet while providing a desired amount of durability, support, and protection to the wearer's foot. Soles often include at least two components, an outsole and a midsole. An outsole, if used, contacts the ground or other surface and, therefore, may provide any desired traction properties in sufficient resilience to last the intended lifespan of the shoe without degrading or wearing through due to friction during walking, running, etc. A midsole, if used, may provide cushioning to the wearer's foot, which may be particularly desirable for activities, such as many sports, that often involve a wearer's foot impacting the ground, floor, or other surface repeatedly and/or with great force. Even many non-athletes prefer to wear shoes that provide considerable cushioning from the combined midsole and outsole assemblies similar to those found in many sports shoes and may likewise prefer the support and/or protection often provided by a sports shoe upper.

While the examples of shoe uppers and shoe bottom units are presented in a simplified fashion for exemplary purposes herein, in practice a shoe upper may comprise a large number of individual parts, often formed from different types of materials. The components of a shoe upper may be joined together using a variety of adhesives, stitches, and other types of joining components. A shoe bottom unit often may comprise a shoe sole assembly with multiple components. For example, a shoe bottom unit may comprise an outsole made of a relatively hard and durable material, such as rubber, that contacts the floor, ground, or other surface. A shoe bottom unit may further comprise a midsole formed from a material that provides cushioning and absorbs force during normal wear and/or athletic training or performance. Examples of materials often used in midsoles are, for example, ethylene vinyl acetate foams, polyurethane foams, and the like. Shoe bottom units may further have additional components, such as additional cushioning components (such as springs, airbags, and the like), functional components (such as motional control elements to address pronation or supination), protective elements (such as resilient plates to prevent damage to the foot from hazards on the ground or floor), and the like. While these and other components that may be present in a shoe upper and/or a shoe bottom unit are not specifically described in examples set forth herein, such components may be present in articles of footwear manufactured using systems and methods in accordance with aspects hereof.

Referring now to FIG. 1, an exemplary shoe upper 100 and a shoe bottom unit 102 are depicted prior to being connected to one another. The upper 100 is positioned around a last 104 to aid in the connection between the upper 100 and the bottom unit 102. Still further, the upper 100 includes multiple layers of material that make up the upper 100. For instance, the upper 100 includes a heel layer 106, a midfoot layer 108, and a toe layer 110. The connection between the heel layer 106 and the midfoot layer 108 results in a seam 112. The connection between the midfoot layer 108 and the toe layer 110 results in a seam 114. Still further, a bite line 116 is shown which extends around the entire circumference of the upper 100 and demarks the line above which adhesive should not be applied to ensure no unsightly discoloration or excessive beading. The bite line 116 can be an actual temporary visible line, a UV light visible line, a virtual line, or any other suitable line of demarcation. As is apparent, buffing of the upper 100 should take place below the bite line 116. Specifically, a buffing zone 118 is shown that extends around the entire circumference of the upper 100. The buffing zone 118 is where a suitable adhesive will be applied to ensure adequate bonding of the upper 100 to the bottom unit 102. The buffing zone 118 also extends through both seams 112 and 114.

With reference to FIGS. 2-5, an auto buffing apparatus 200 is depicted in accordance with aspects hereof. The apparatus 200 is adapted to be positioned onto the end of a mechanical or robotic arm so that it is capable of engaging the upper 100 in all or any suitable part of the buffing zone 118. The apparatus 200 includes a housing 202 having a top wall 204, sidewalls 206, and a partial bottom wall 208.

The apparatus 200 further includes a carriage 210 slideably mounted to the housing 202 in such manner to allow linear movement towards and away from the upper 100, as will be more fully described below. The carriage 210 is slideably mounted to the housing 202 by a pair of slide rail bearings 212 positioned on each side of the carriage 210. Suitable slide rail bearings include those available from GMT Global, Inc. of Changhua, Taiwan. Each slide rail bearing 212 includes a bottom rail 214 and a top rail 216. The bottom rail 214 is fixedly secured to the partial bottom wall 208 of the housing 202 via screws 218, or any other suitable attachment structure. The top rail 216 is fixedly secure to the carriage 210 via screws 220. The rails 214 and 216 are slideably engaged via bearings to provide smooth linear motion between the rails, and thus, provide smooth linear motion between the housing 202 and the carriage 210.

A rotatable spindle 222 is received in an aperture 224 of the carriage 210 and is fixedly mounted to the carriage 210 so as to slideably move with the carriage 210. The spindle 222 has a lower end 223 which extends through an opening 226 formed in the partial bottom wall 208. The lower end 223 receives a buffing tool 228 that includes a buffing surface 230 for engaging the upper 100. The buffing tool 228 is rotated by the spindle 222 in any suitable manner. For instance, the spindle 222 can be powered by an electric motor, a hydraulic motor, a pneumatic motor, or any suitable power source capable of rotating motion.

As the carriage 210 is moved linearly, so is the spindle 222, and thus also the buffing tool 228 and the buffing surface 230. As will be more fully described below, this linear movement allows a consistent force to be applied during the buffing process even when external forces such as gravity are acting on the apparatus 200.

Figure 3:
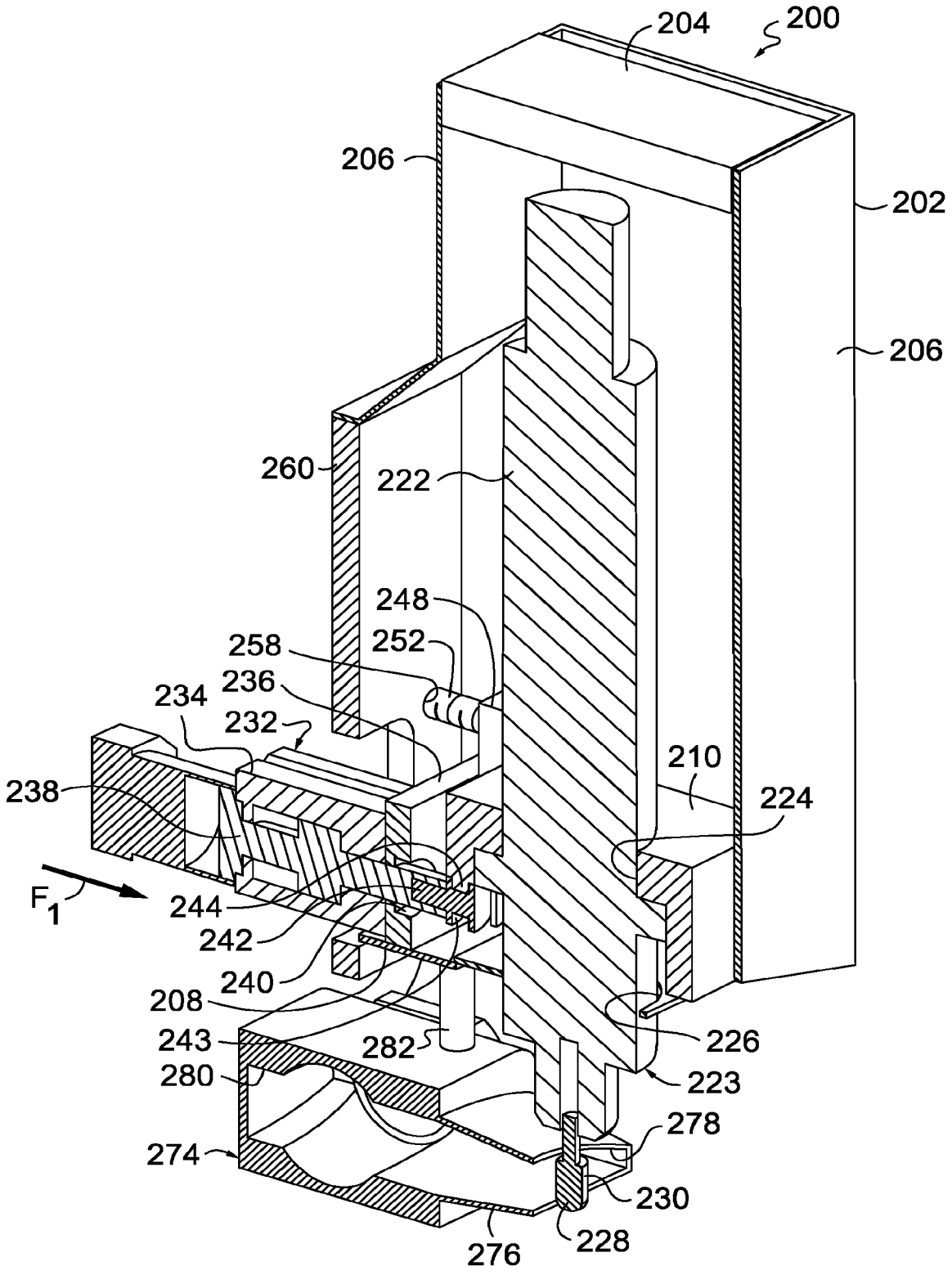
FIG. 3 depicts a cross sectional perspective view of the apparatus of FIG. 2, in accordance with exemplary aspects hereof.
Figure 4:
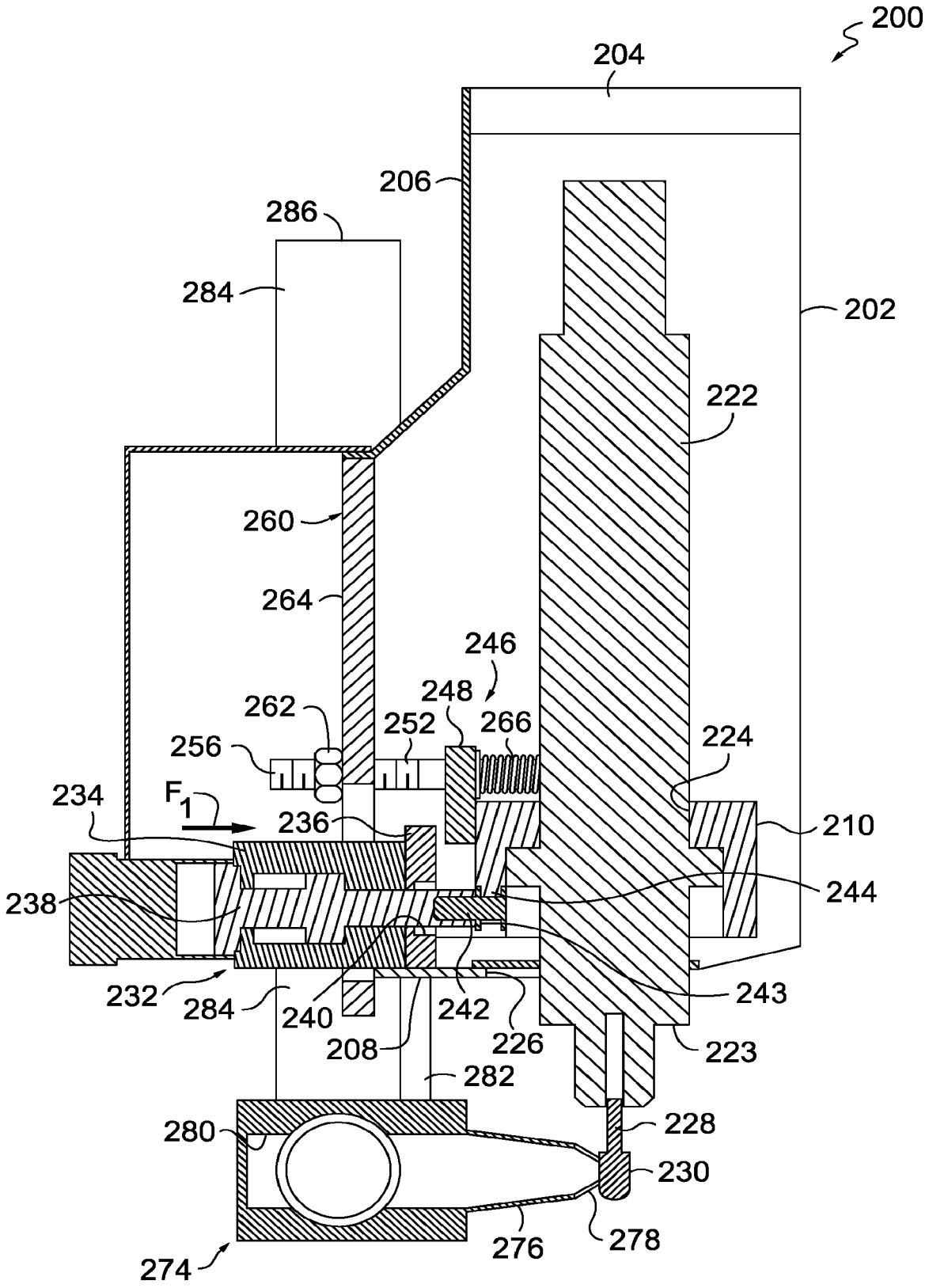
FIG. 4 depicts a cross sectional view taken along line 4-4 of FIG. 2, in accordance with exemplary aspects hereof.

With reference to FIGS. 3 and 4, the apparatus 200 further includes an actuator 232 for applying a force $F_1$ to carriage 210. The actuator 232 includes a cylinder 234 which is mounted to the housing 202 via a mounting plate 236 extending upwardly from and connected to the bottom wall 208. The cylinder 234 is fixedly mounted to the plate 236 via any suitable structure for instance bolts, pins, screws or welding, etc. The cylinder 234 has a movable piston 238 capable of linear movement in a direction toward the shoe upper 100. The piston 238 extends through an aperture 240 in the mounting plate 236 and is fixedly secured to the carriage 210 by a terminal connection pin 242. The pin 242 is fixedly secured to the piston 238 through any suitable arrange for instance a male/female thread arrangement. The pin 242 is fixedly secured to the carriage 210 via a channel 243. The channel 243 receives a tab 244 of the carriage 210 so that as the piston 238 moves so does the carriage 210, and thus, the spindle 222. In this manner, the actuator 232 can apply a force $F_1$ onto the buffing tool 228 to be further applied to the shoe upper 100. It is contemplated that the actuator 232 is a one way actuator in the sense that it is able to power only in the direction of force $F_1$. Thus as power is supplied to the actuator 232, the piston is moved in the direction of force $F_1$. In order for the piston 238 to be retracted, a source external to the actuator 232 would be applied in a direction opposite to the force $F_1$.

It is contemplated that the actuator 232 can be powered in any suitable manner, for instance pneumatically, hydraulically, mechanically and/or electrically. Further, although the actuator has been described as a one way action, it would be possible to have a two way action actuator that is capable of retracting the piston 238 utilizing its own power and not an external source.

Figure 2:
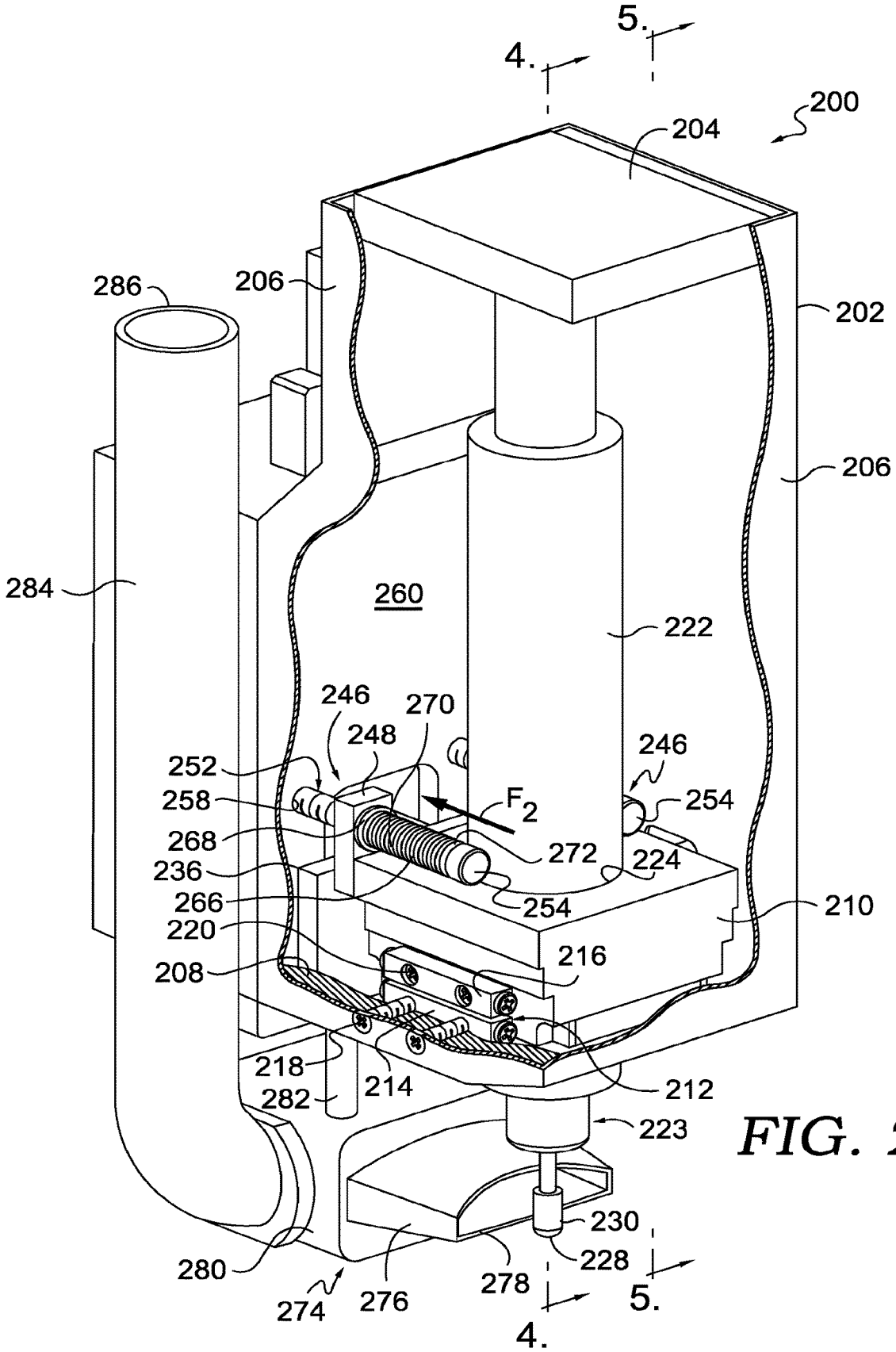
FIG. 2 depicts a perspective view of an exemplary buffing apparatus, parts broken away to reveal details of construction, in accordance with exemplary aspects hereof.
Figure 5:
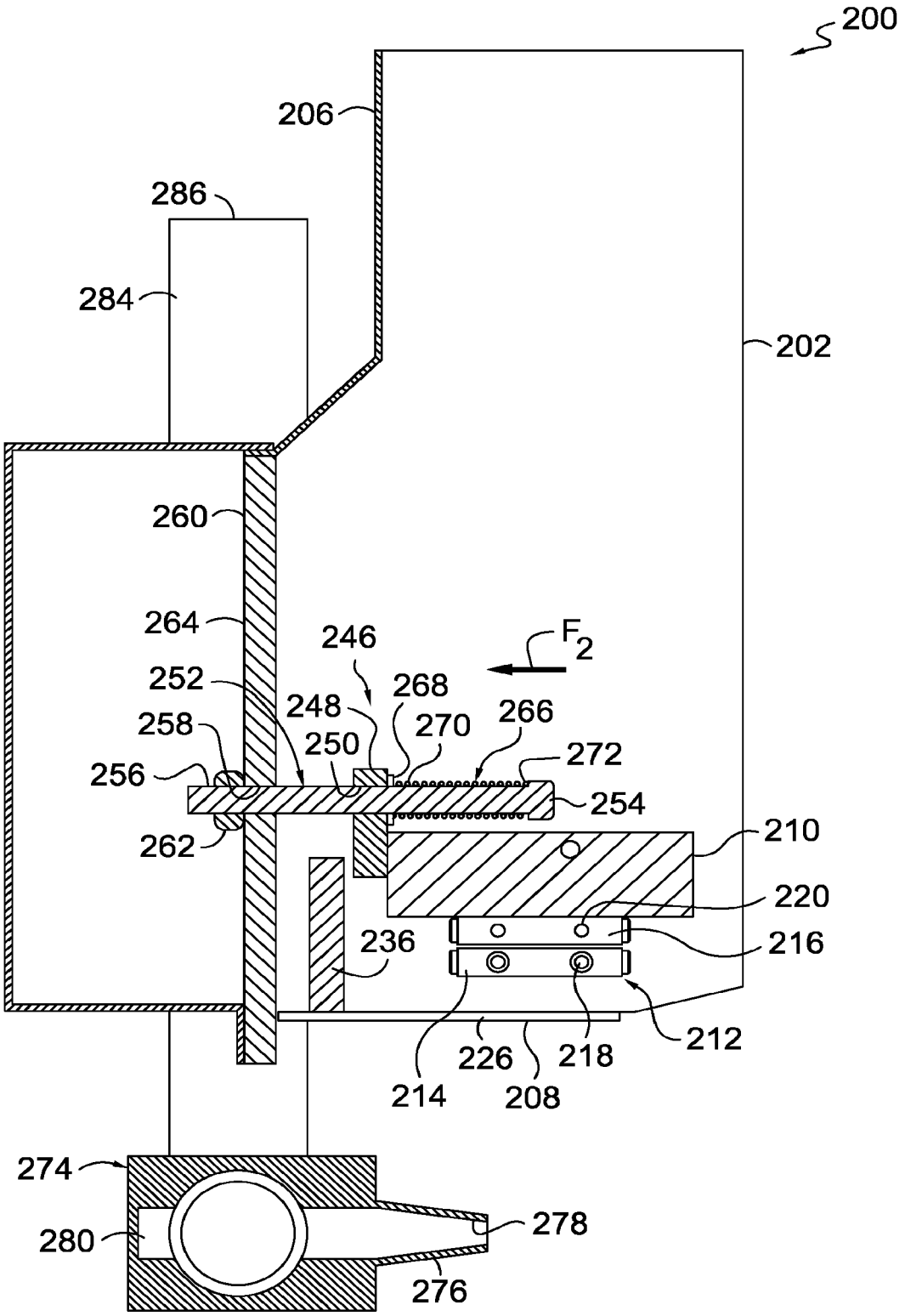
FIG. 5 depicts a cross sectional view taken along line 5-5 of FIG. 2, in accordance with exemplary aspects hereof.

With reference to FIGS. 2, 4 and 5, in order to return the piston 238 to its retracted position, a biasing mechanism 246 is provided. The biasing mechanism 246 includes a pair of ears 248 fixedly secured to and extending upwardly from opposite sides of the carriage 210. Each ear 248 includes an aperture 250 formed therein for receiving a biasing base bolt 252. Each bolt 252 includes a head 254 on an end closest to the upper 100 and a threaded portion 256 on an end farthest away from the upper 100. The threaded portions 256 of the bolts 252 are received in apertures 258 formed in a thickened back wall section 260. A nut 262 is threadably received onto the threaded portions 256 on a back surface 264 of the back wall 260. The nuts 262 can be used to set an initial bias to the biasing mechanism 246 as will be further described below.

Each biasing mechanism also includes a spring 266 positioned around the bolt 252 and between the head 254 and the ear 248 of the carriage 210. A washer 268 is also positioned on the bolt 252 and between a first end 270 of the spring 266, and a second end 272 of the spring 266 engaged with the head 254. In this manner, each of the springs 266 can be placed in compression between its respective ear 248 and bolt head 254. The compression of the springs 266 results in a force $F_2$ being applied to the carriage 210 via ears 248, and thus, also to the piston 238 of the actuator 232. As a result of this construction of the biasing mechanisms 246, the compression in the springs 266 can be used to return the piston 238 toward its retracted position as the force $F_1$ exerted by the actuator 232 is reduced or eliminated completely.

The nuts 262 can be used to adjust the initial compression in the springs 266 by simply tightening the nuts 262 on the threaded portions 256. As is apparent, the tightening of the nuts 262 results in the heads 254 being drawn closer to the ears 248, and thus, the compression of the springs 266 therebetween.

Although the biasing mechanisms 246 are described above as utilizing a spring 266, it is apparent that any suitable biasing material or force could be used, for instance, but not limited to rubber, pneumatic, or hydraulic shock absorbers, deflection plates, leaf springs, etc.

The above description of the biasing mechanisms 246 focuses on the use of the biasing force $F_2$ to counteract and help retract the piston 238. However, the biasing mechanisms 246 perform another function of ensuring smooth transitioning in the area of the seams 112, 114 as will be more fully explained below.

With reference to FIGS. 2-5, the apparatus 200 further includes a vacuum assembly 274 for suctioning away material removed from the shoe upper during the buffing process. The vacuum assembly 274 includes a suction cone 276 having an aperture 278 located adjacent to the buffing tool 228 at a position that is opposite to where the buffing tool engages the upper 100. The cone 275 is in fluid communication with a suction chamber 280. The suction chamber 280 is mounted to the bottom wall 208 of the housing 202 via a pair of mounting posts 282 in such a manner that the aperture 278 is adjacent to the buffing tool 228. Thus, as the apparatus 200 moves so does the suction chamber 280. A pair of vacuum supply tubes 284 are further in fluid communication with the suction chamber 280 to provide the suction force to the suction cone 276. The upper ends 286 of the tubes are in fluid communication with any suitable vacuum source (not shown). In this manner the vacuum assembly 274 is used to minimize the amount of buffing residue that remains on the shoe upper 100 after it is buffed, such residue likely resulting in a decreased efficiency of the adhesive bond between the upper 100 and the bottom unit 102.

Figure 6:
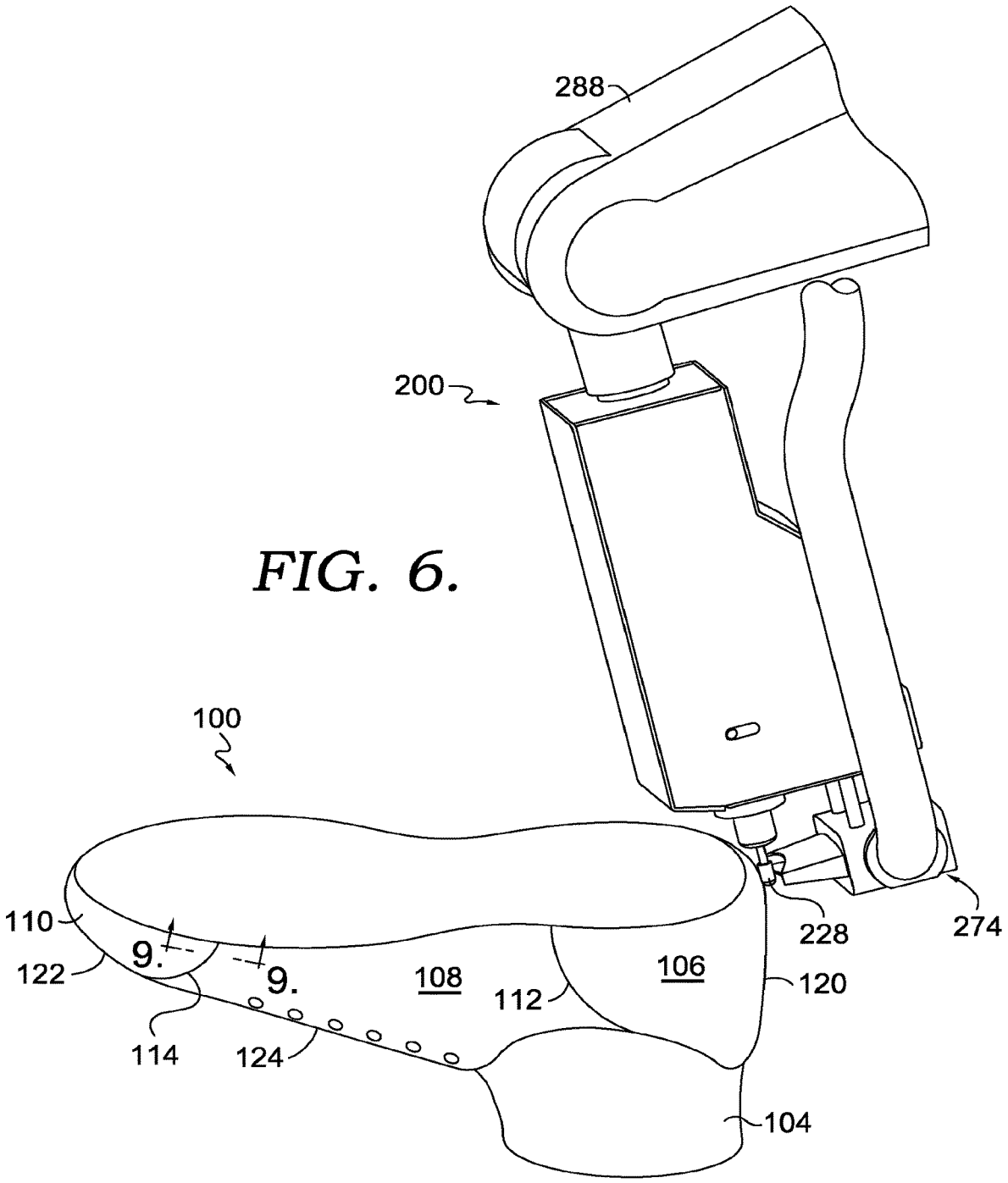
FIG. 6 depicts a perspective view of the apparatus of FIG. 2 during a buffing operation on the heel portion of a shoe upper, in accordance with exemplary aspects hereof.
Figure 7:
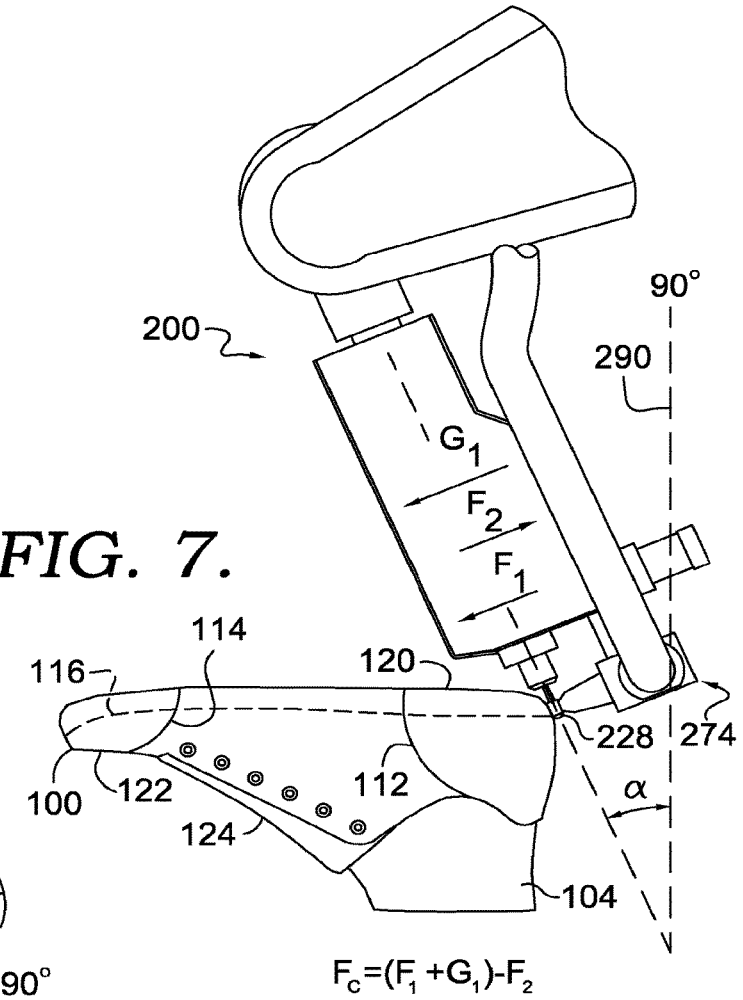
FIG. 7 depicts a side plan view of the apparatus of FIG. 2 during a buffing operation of the heel portion of the shoe upper and showing a gravity force being exerted on the apparatus so as to increase the engagement with the shoe upper, in accordance with exemplary aspects hereof.
Figure 8:
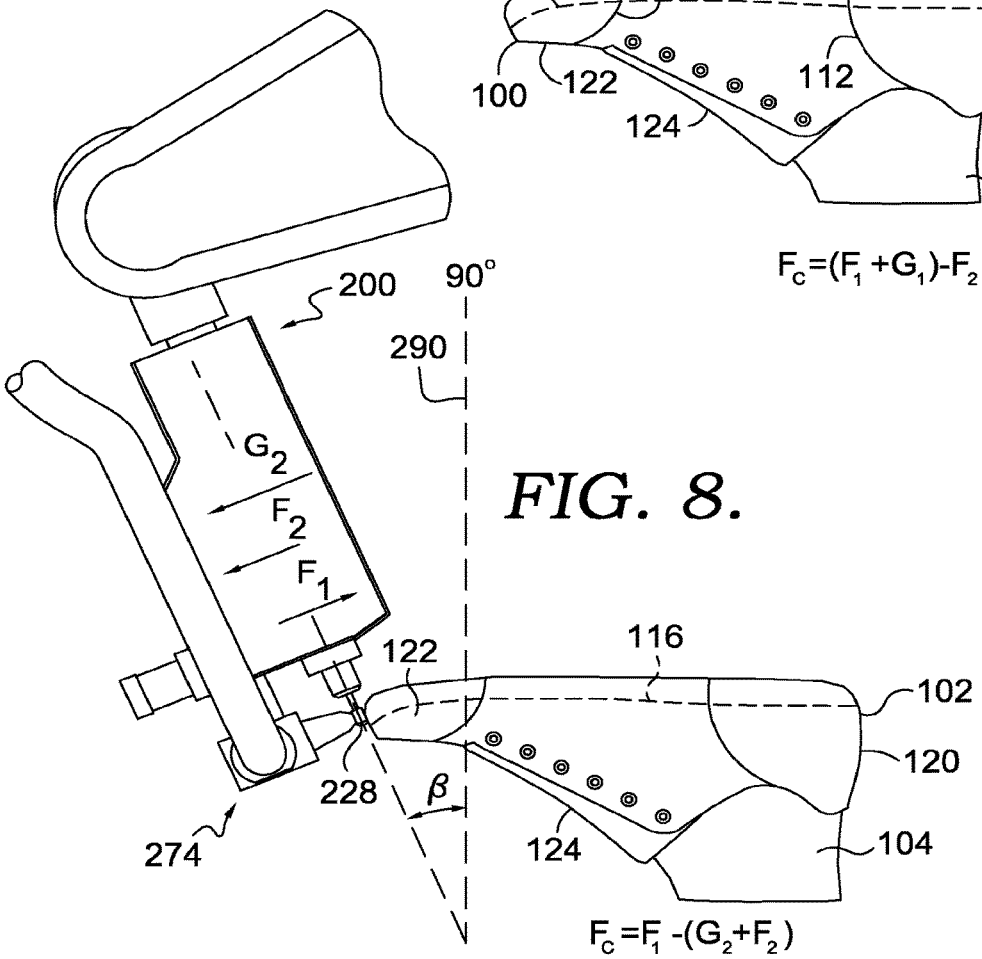
FIG. 8 depicts a side plan view of the apparatus of FIG. 2 during a buffing operation of the toe portion of the shoe upper and showing a gravity force being exerted on the apparatus so as to decrease engagement with the shoe upper, in accordance with exemplary aspect hereof.

With reference to FIGS. 6-8, the operation of the buffing apparatus 200 will be described. The apparatus 200 is positioned on a robotic arm 288 for instance and can be rotated around the circumference of the upper 100 which is held in place on the last 104. The upper 100 and the last 104 are inverted from FIG. 1 so that the sole portion of the upper is facing upward. In addition to being able to articulate around the circumference of the shoe upper, the robotic arm 288 is able to adjust the angle of the apparatus 200, and thus, the angle of the buffing tool 228. This is especially helpful when buffing for instance the heel area 120 and the toe area 122 of the upper 100. However, it may also be necessary to adjust the angle of the apparatus along the side area 124 of the upper 100.

As discussed above, in an aspect hereof, it is desirable to apply a constant contact force $F_C$ to the all portions of the upper being buffed. As an example, force $F_C$ could be 1 kg to 6 kg, such as 3 kg. In order to keep the force $F_C$ constant when gravity forces $G_1$ are acting on the apparatus 200, adjustments will be made to force $F_1$ by the actuator 232 and in response to such adjusts changes will occur in the force $F_2$.

With reference to FIG. 7, the buffing of the heel area 120 will be described. In order to adequately buff the heel area 120 it is necessary to angle the buffing apparatus 200 by the angle α from the perpendicular or 90 degree axis 290. This results in the buffing tool 228 also being angled by the angle α. This angling results in an additional gravity force $G_1$ being applied to the buffing apparatus 200, and thus, also being applied to the buffing tool 228 and the shoe upper 100. In order to prevent the contact force $F_C$ from being too great, the force $F_1$ applied by the actuator 232 will be decreased by an appropriate amount to keep a constant contact force $F_C$. The biasing mechanism 246 will assistant in the force balance by insuring that the piston 238 is sufficiently retracted to keep the constant contact force $F_C$. The general equation for the value of the contact force when gravity is adding force to the shoe upper is:

$$F_C=(F_1+G_1)-F_2$$

Thus, in order to for instance keep a constant contact force of 3 kg, it may be necessary to initially activate the actuator 232 to a value of 4 kg for the force $F_1$, which will compress the biasing mechanism 246 such that an opposite force $F_2$ with a value of 1 kg is generated. At the initial stage, the buffing apparatus 200 is perpendicular with no angle, and thus, the gravity force directed toward the shoe upper 100 is zero. Therefore, the contact force $F_C$ is as follows;

$$F_C(3\text{ kg})=(F_1(4\text{ kg})+G_1(0\text{ kg}))-F_2(1\text{ kg})$$

If however there is a gravity force $G_1$ of, for example 1 kg, acting on the buffing apparatus as there is in the heel area 120 as shown in FIG. 7, in order to maintain a constant contact force, the equation is as follows;

$$F_C(3\text{ kg})=(F_1(3\text{ kg})+G_1(1\text{ kg}))-F_2(1\text{ kg})$$

Thus, to keep a constant contact force of 3 kg, the force $F_1$ exerted by the actuator 232 is decreased from 4 kg to 3 kg because of the gravity force $G_1$.

With reference to FIG. 8, the buffing of the toe area 122 will be described. In order to adequately buff the toe area 122, it is necessary to angle the buffing apparatus 200 by the angle β from the perpendicular axis 290. This results in the buffing tool 228 also being angle by the angle β. This angling and the fact that the buffing tool 228 is operating on the bottom surface of the toe area 122 results in a gravity force $G_2$ that is pulling the buffing apparatus 200, and thus, the buffing tool 228, away from the shoe upper 100. In order to prevent the contact force $F_C$ from being too little, the force $F_1$ applied by the actuator 232 will be increased an appropriate amount to keep a constant contact force $F_C$. The general equation for the value of the contact force $F_C$ when gravity is pulling the buffing apparatus 200 away from the shoe upper is:

$$F_C=F_1—(G_2+F_2)$$

Thus, in order to, for instance, keep a constant contact force of 3 kg, it may be necessary to initially activate the actuator to a value of 4 kg for force $F_1$, which will compress the biasing mechanism 246 such that an opposite force $F_2$ with a value of 1 kg is generated. Because at the initial stage the buffing apparatus 200 is perpendicular with no angle, the gravity force directed toward the shoe upper 100 is zero. Thus, the contact force $F_C$ is as follows;

$$F_C(3\text{ kg})=F_1(4\text{ kg})-(G_2(0\text{ kg}))+F_2(1\text{ kg})$$

If however there is a gravity force $G_2$ of say 1 kg acting on the buffing apparatus 200, as there is in the toe area 122 as shown in FIG. 8, in order to maintain a constant contact force, the equation is as follows;

$$F_C(3\text{ kg})=F_1(5\text{ kg})-(G_2(1\text{ kg}))+F_2(1\text{ kg}))$$

Thus, in order to keep a constant contact force of 3 kg, the force $F_1$ exerted by the actuator 232 is increased from 4 kg to 5 kg because of the gravity force $G_2$.

Figure 9:
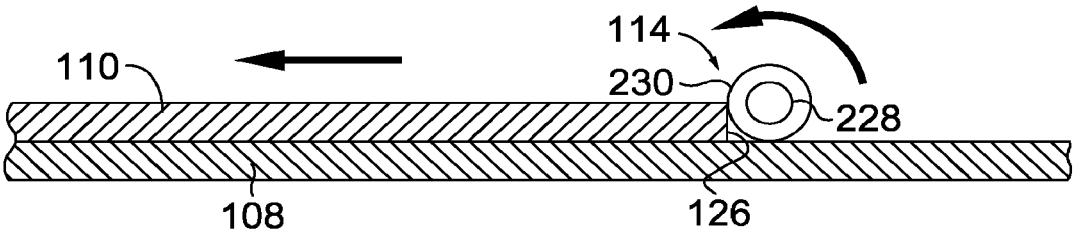
FIG. 9 depicts a diagrammatic view taken along line 9-9 of FIG. 6 and depicting a seam portion of the shoe upper with the buffing head moving in a first direction so as to transition from an upper layer further away from the buffing head to an upper layer closer to the buffing head, in accordance with exemplary aspects hereof.
Figure 10:
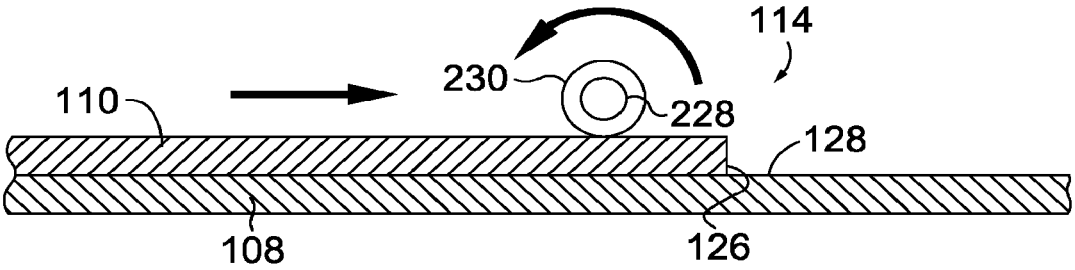
FIG. 10 depicts a diagrammatic view of a seam portion of the shoe upper similar to FIG. 9, but showing the buffing head moving in a second direction so as to transition from an upper layer closer to the buffing head to an upper layer further away from the buffing head, in accordance with exemplary aspects hereof

With reference to FIGS. 9 and 10, the function of the biasing mechanisms 246 as a buffer/shock absorber in relation to the seams 112, 114 will be described. In FIG. 9, the overlapping arrangement between the toe layer 110 and the midfoot layer 108 of the upper 100 is depicted along the seam 114. The overlapping relationship creates a ledge or step off 126. The biasing mechanism 246 assists in the smooth transition of the buffering tool 228 in this ledge are 126 as will be more fully explained below.

FIG. 9 depicts the buffering tool 228 moving in a direction as indicated which is from the midfoot layer 108 to the toe layer 110 of the upper 100. Thus, the buffing tool 228 must move up the ledge 126 smoothly in order to prevent surplus material from being removed from the toe layer 110. The springs 266 are always under compression during use of the buffing apparatus 200 and allow for the slight adjustment of buffing tool 228 away from the shoe upper 100 without removing too much of the toe layer 110.

FIG. 10 depicts the buffering tool 228 moving in direction as indicated which is from the toe layer 110 to the midfoot layer 108 of the upper 100. Thus, the buffing tool 228 must move down the ledge 126 smoothly in order to not miss the area 128 of the midfoot layer 108 that is closest to ledge 126. Again, because the springs 266 are always under compression during use of the apparatus 200, the slight adjustment of the buffing tool 228 towards the shoe upper 100 is accommodated by the springs 266 to buff as much of the area 128 of the midfoot layer 108 as possible. Thus, in addition to assisting the balance of forces when the buffing apparatus 200 is angled and subject to gravity forces, the biasing mechanisms also performs a buffer/shock absorption function.

Figure 11:
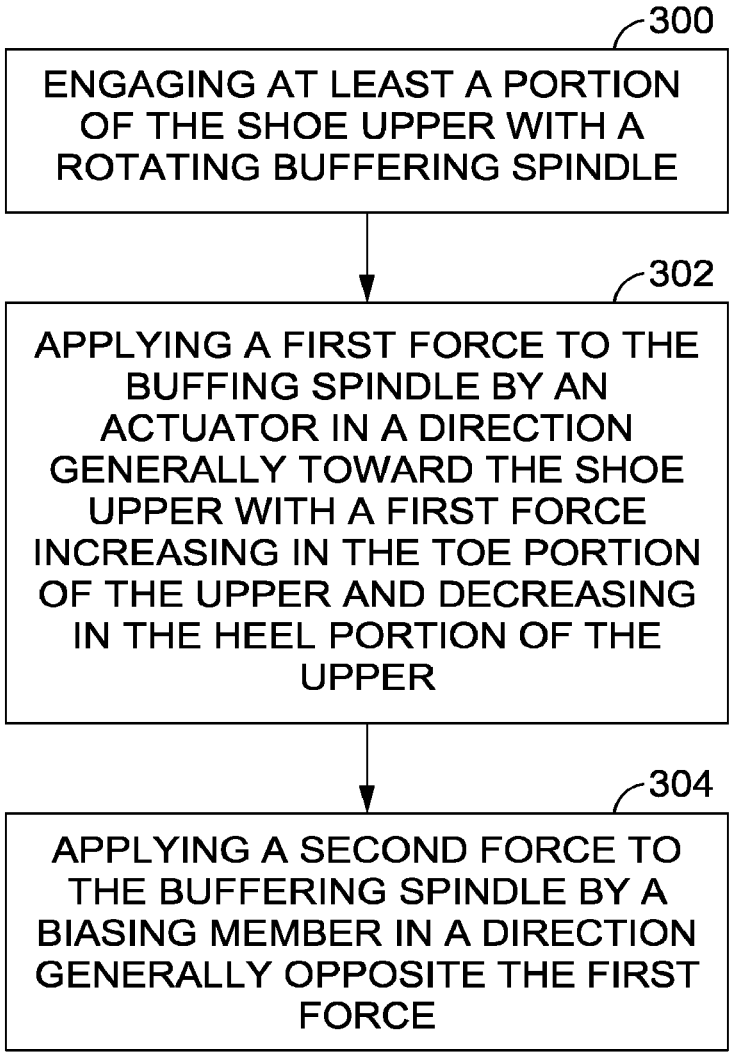
FIG. 11 depicts a exemplary method of buffing a shoe upper, in accordance with the exemplary aspect hereof.

With reference to FIG. 11, a method of buffing a shoe upper 100 is described. At block 300, the rotating buffing spindle engages at least a portion of the shoe upper 100. At block 302, an actuator applies a first force to the buffing spindle in a direction generally toward the shoe upper and the first force is increased at the toe portion of the shoe upper and decreased in the heel portion of the shoe upper. At block 304, a biasing member applies a second force to the buffing spindle in a direction generally opposite the first force. The method can further include linearly moving the spindle towards the shoe upper. It can also include compressing of the biasing member by the actuator so as to result in an increase in the value of the second force. The method can further include mounting a slideable carriage to the buffing spindle to allow movement towards the shoe upper.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

The invention claimed is:

1. An apparatus for buffing a footwear part comprising:

a housing adapted to be articulated around at least a portion of the footwear part;

a rotating spindle positioned in the housing and having a buffing surface for engagement with the footwear part;

a carriage connected to the housing and receiving the spindle such that the buffing surface can be moved closer to and further away from the footwear part;

an actuator connected with the carriage, wherein the actuator is capable of applying force to the carriage to increase the force of the buffing surface onto the footwear part; and a biasing member connected with the carriage, wherein the biasing member exerts a force onto the carriage in a direction opposite the force exerted by the actuator.

2. The apparatus of claim 1, wherein the actuator is a hydraulic cylinder.

3. The apparatus of claim 1, wherein the biasing member is a spring that is compressed by movement of the actuator such that the spring force is opposed to the actuator force.

4. The apparatus of claim 1, wherein the carriage is mounted to the housing using at least one slide rail ball bearing set.

5. The apparatus of claim 1, further comprising a vacuum in fluid communication with an opening positioned adjacent the buffing surface to remove excess material resulting from a buffing action.

6. The apparatus of claim 1, wherein the housing is positioned on a robotic arm for automatically positioning the buffing surface adjacent specific portions of the footwear part.

7. The apparatus of claim 1, wherein the footwear part is a shoe upper.

8. A system for buffing a portion of an upper of an article of footwear comprising:

a rotatable spindle having a buffing surface capable of engaging the upper;

a robotic arm having the rotatable spindle mounted thereto and capable of articulating the buffing surface adjacent to selected portions of the upper, the spindle movable with respect to the robotic arm;

an actuator coupled to the spindle and capable of apply force from the buffing surface toward the upper; and a biasing mechanism coupled to the spindle, wherein the biasing mechanism applies a force directed away from the upper when the actuator applies a force towards the upper.

9. The system of claim 8, wherein the biasing mechanism includes a spring that is compressed when the actuator exerts force towards the upper.

10. The system of claim 8, further comprising a carriage mounted to the robotic arm and receiving the spindle such that the buffing surface can move towards the upper as a result of movement of the carriage.

11. The system of claim 8, wherein the actuator is a single action pneumatic cylinder and wherein the biasing mechanism is configured to return a piston of the cylinder to its original position.

12. The system of claim 10, wherein the carriage is mounted to the robotic arm via at least one slide rail ball bearing set.

13. The system of claim 8, further comprising a vacuum in fluid communication with an opening positioned adjacent the buffing surface to remove excess material resulting from a buffing action.

* * * * *